US005325956A

United States Patent [19]

Keen, Jr.

[11] Patent Number: 5,325,956

[45] Date of Patent: Jul. 5, 1994

[54] METHOD AND APPARATUS FOR ORIENTING ELONGATED COMPONENTS WITH DISTINCT ENDS

[75] Inventor: Billy J. Keen, Jr., Chesterfield, Va.

[73] Assignee: Philip Morris Incorporated, New York, N.Y.

[21] Appl. No.: 22,720

[22] Filed: Feb. 24, 1993

[51] Int. Cl.[5] ..... B65G 47/24

[52] U.S. Cl. ..... 198/395; 198/399

[58] Field of Search ..... 198/395, 399; 131/282, 131/283

[56] References Cited

U.S. PATENT DOCUMENTS

| | | | |
|---|---|---|---|
| 2,877,884 | 3/1959 | Esenwein | 198/395 |
| 3,215,250 | 11/1965 | Schubert | 198/33 |
| 3,372,702 | 3/1968 | Bohn et al. | 131/94 |
| 3,472,355 | 10/1969 | Menge | 198/33 |
| 3,583,546 | 6/1971 | Koop . | |
| 3,625,103 | 12/1971 | Giatti | 83/102 |
| 3,696,910 | 10/1972 | Schmermund et al. | 198/33 |
| 4,167,995 | 9/1979 | Schumacher | 198/458 |
| 4,211,318 | 7/1980 | Verjux | 198/377 |
| 4,236,624 | 12/1980 | Buzzi | 198/399 |
| 4,483,349 | 11/1984 | Dyett et al. | 131/94 |
| 4,483,351 | 11/1984 | Seragnoli | 131/282 |
| 4,538,629 | 9/1985 | Grasse et al. | 131/282 |
| 4,577,644 | 3/1986 | Grieben | 131/94 |
| 4,605,015 | 8/1986 | Grieben | 131/94 |
| 4,664,249 | 5/1987 | Gherardi | 198/410 |
| 4,802,568 | 2/1989 | Haarer et al. | 198/399 |
| 5,127,511 | 7/1992 | Keen, Jr. et al. | 198/461 |

FOREIGN PATENT DOCUMENTS

WO90/15765 6/1990 PCT Int'l Appl. .

*Primary Examiner*—Joseph E. Valenza

*Attorney, Agent, or Firm*—Kevin B. Osborne; James E. Schardt; Charles E. B. Glenn

[57] ABSTRACT

A method and apparatus for orienting elongated components, where the components are initially oriented in a random manner with respect to the ends of the components. Improperly oriented components are separated from properly oriented ones and are transferred to a turnaround device; this device rotates the improperly oriented components 180° about a transverse axis running from one end of the component to the other end of the component. The stream of rotated elongated components is then reintegrated with the stream of elongated components which were initially properly oriented. All of the elongated components are then removed from the orienting apparatus. The output stream of properly oriented elongated components coincides with the input stream of randomly oriented elongated components.

21 Claims, 3 Drawing Sheets

FIG. 2
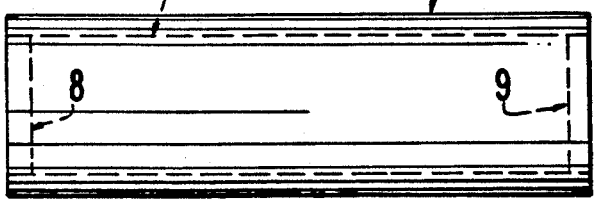
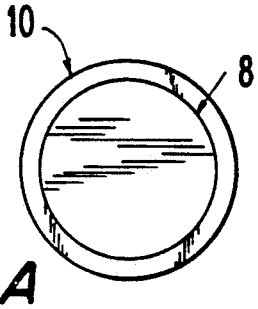
FIG. 2A
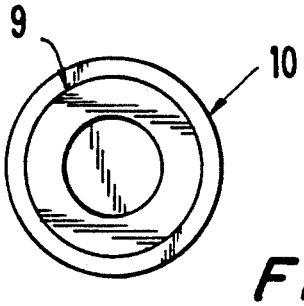
FIG. 2B
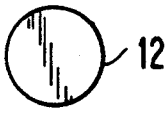
FIG. 4
FIG. 5A
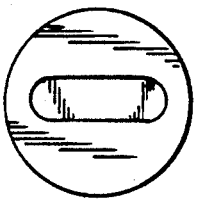
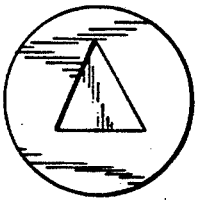
FIG. 5B
FIG. 5C
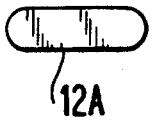
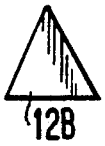
FIG. 5D

METHOD AND APPARATUS FOR ORIENTING ELONGATED COMPONENTS WITH DISTINCT ENDS

BACKGROUND OF THE INVENTION

The present invention relates to a mechanism for uniformly orienting elongated components having distinct and readily identifiable ends, where such components were initially randomly oriented. More specifically, the invention is capable of automatically converting a randomly oriented steady-stream input of elongated objects into a uniformly oriented steady-stream output of such objects.

The prior art shows methods and apparatus for tip-turning non-randomly aligned cylindrical objects, such as cigarettes, through 180°, to achieve a stream of properly aligned objects.

For example, U.S. Pat. No. 3,215,250 describes a method and apparatus for rotating, by 180°, every cigarette of one of two rows of cigarettes exiting a cigarette-making machine. The rotation results in the filters of both rows of the cigarettes pointing in the same direction. The cigarettes are rotated by rotating the flute in which they are positioned through 180°. Once rotated, the two rows of cigarettes are combined into a single row of properly oriented cigarettes.

U.S. Pat. No. 4,664,249 describes a method and apparatus for aligning each succeeding pair of non-randomly oriented cigarettes. Pairs of coaxial cigarettes with their filter ends oriented in opposite directions are fed to the mechanism. One cigarette from each pair is tip-turned 180° so that each pair of cigarettes discharged from the mechanism has its filter ends oriented in the same direction.

U.S. Pat. No. 4,577,644 also describes a method and apparatus for orienting each succeeding pair of non-randomly oriented cigarettes or other smoking products. Two rows of oppositely oriented cigarettes are formed when a cigarette of double unit length with a double-length filter in its middle is cut in two. One cigarette from each of the pairs is tip-turned 180° to produce a single row of cigarettes, with both filter ends oriented in the same direction.

A drawback of these prior art inventions is that they are only capable of acting upon each one of a continuous stream of succeeding cylindrical objects. That is, the prior art devices are not able to discriminate between cylindrical objects which are properly oriented and those which are improperly oriented, reorienting only those objects which are improperly oriented.

SUMMARY OF THE INVENTION

It is therefore an object of this invention to provide a turning mechanism that can discriminate between properly and improperly oriented elongated objects.

Another object of this invention to provide a mechanism that can discriminate between properly and improperly oriented elongated objects, that will realign only those objects that are improperly aligned, and will produce a continuous output of properly aligned elongated objects with no waste or rejection of input materials.

It is a further object of this invention to provide a mechanism that can accept an input of randomly aligned elongated objects and provide an output of such objects in a uniformly aligned manner.

Another object of this invention is to provide a mechanism which can produce an output of uniformly aligned elongated objects at a steady-stream rate that is equal to the rate at which such objects are input into the apparatus.

In accordance with these objectives, there is provided a method and apparatus for orienting randomly oriented cylindrical components having one capped end and one open end.

In the preferred embodiment, the mechanism is comprised of six drums that are aligned in a staggered formation. Each drum has flutes on its circumference that are of approximately the same dimensions as the components to be oriented—although cut in half lengthwise—and are positioned equidistant from one another around each drums' circumference.

Randomly oriented cylindrical components are fed to a positioning drum by a system such as disclosed in U.S. Pat. No. 5,127,511, where each component is placed in a flute without regard to the orientation of the component's end. Once in place on the positioning drum, properly oriented components are fed to a series of transfer drums and then to the assembly drum. Improperly oriented components are identified and transferred to the 180°-turning drum. Components fed to the 180°-turning drum are turned to orient their ends properly. The turned components are then discharged to a transfer drum before being fed to the assembly drum where they fill the flutes left vacant by the feed from the properly oriented transfer drum.

The net result is that each flute of the assembly drum is filled with a properly oriented component. Achievable production speeds for this system have been estimated to be between 2000–5000 components/minute.

DETAILED DESCRIPTION OF THE DRAWINGS

The above and other objects and advantages of the present invention will be apparent upon consideration of the following detailed description, taken in conjunction with the accompanying drawings, in which like reference characters refer to like parts, throughout, and in which:

FIG. 1 is a schematic diagram of a six-drum assembly for orienting cylindrical components including a positioning drum 1, a 180-degree turning drum 3, transfer drums 2, 4, and 5, and an assembly drum 6;

FIG. 2 shows an elongated component 7 placed inside a flute 10, the elongated component 7 having an engaging end 8 and a non-engaging end 9;

FIG. 2A is an end view of FIG. 2, showing the engaging end 8 of the elongated component 7;

FIG. 2B is an end view of FIG. 2, showing the non-engaging end 9 of the elongated component 7;

Figure 3A:
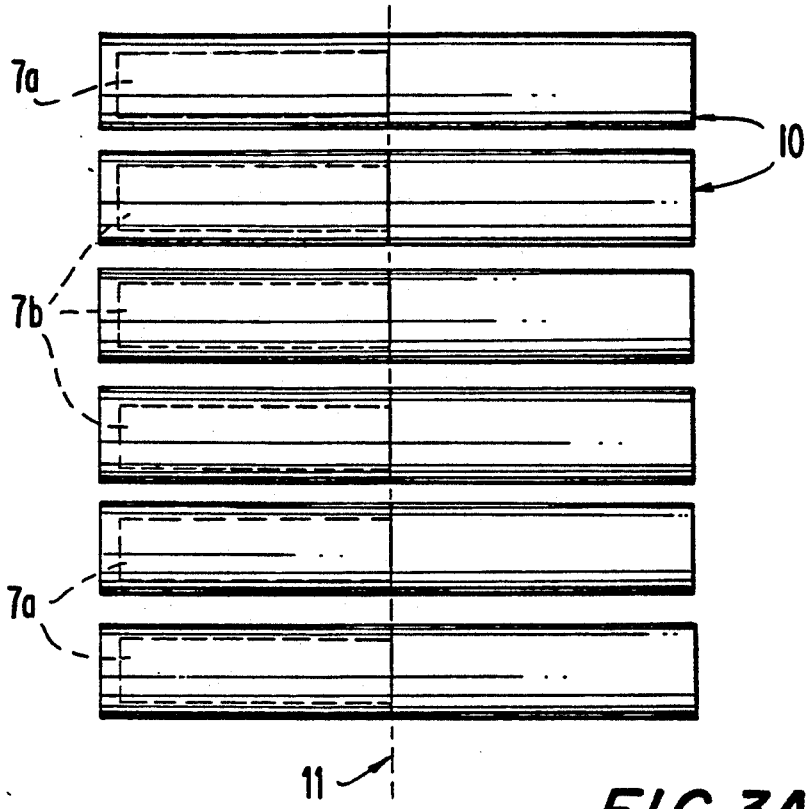
Figure 3B:
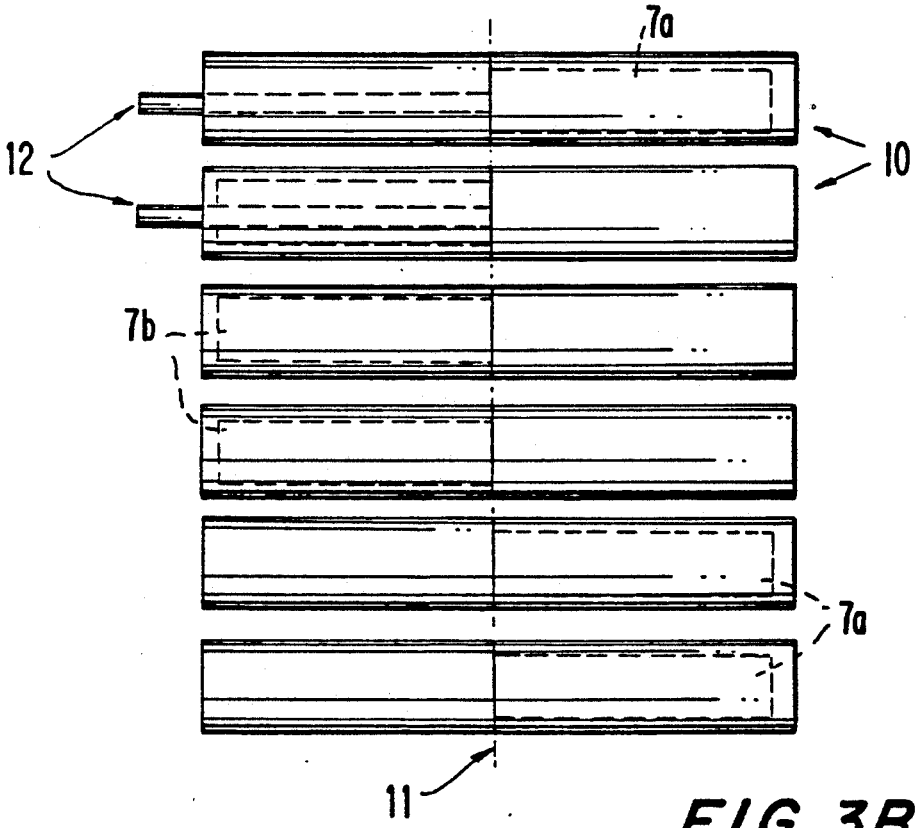

FIGS. 3A and 3B are side-view details of the positioning drum 1 showing randomly oriented cylindrical components 7*a* and 7*b*, each placed in a flute 10, a datum line 11, and push rods 12.

FIG. 4 shows an end-view of a push rod 12 designed to engage the engaging end 8 of the component 7 of FIG. 2, but not to engage the non-engaging end 9 of that component;

FIGS. 5A and 5B show end views of each end of a component 7 with alternate end-geometry.

FIG. 5C shows the end view of a push rod 12A, that will engage the end of the elongated component 7 illustrated in FIG. 5A, but will not engage the end of that component illustrated in FIG. 5B; and FIG. 5D shows the end view of a push rod 12B, that will engage the end of the elongated component 7 illustrated in FIG. 5B, but will not engage the end of that component illustrated in FIG. 5A.

DETAILED DESCRIPTION OF THE INVENTION

In one embodiment of the present invention, the apparatus is comprised of six drums—a positioning drum, a 180°-turning drum, an assembly drum and three transfer drums—each covered with flutes sized to hold the elongated components. The dimensions of the drums are not critical. However, it is preferred that the drums be sized so that the total arc length traveled by a properly oriented component, as measured from the point it is transferred from the positioning drum through its journey along the circumferences of the first and second transfer drums, and along the circumference of the assembly drum to the point where that drum meets the 180°-turning-transfer drum, is equal to the total arc length traveled by an initially improperly oriented component, as measured from the point initially improperly oriented components are transferred from the positioning drum through its journey along the circumferences of the 180° turning drum and the 180°-turning-transfer drum to the point where that drum meets the assembly drum. Sizing the drums in this manner and placing the flutes at equidistant points along the circumferences of each drum will allow a properly oriented component to be placed into every flute on the assembly drum. Alternatively, the drums are belt-shaped.

Figure 1:
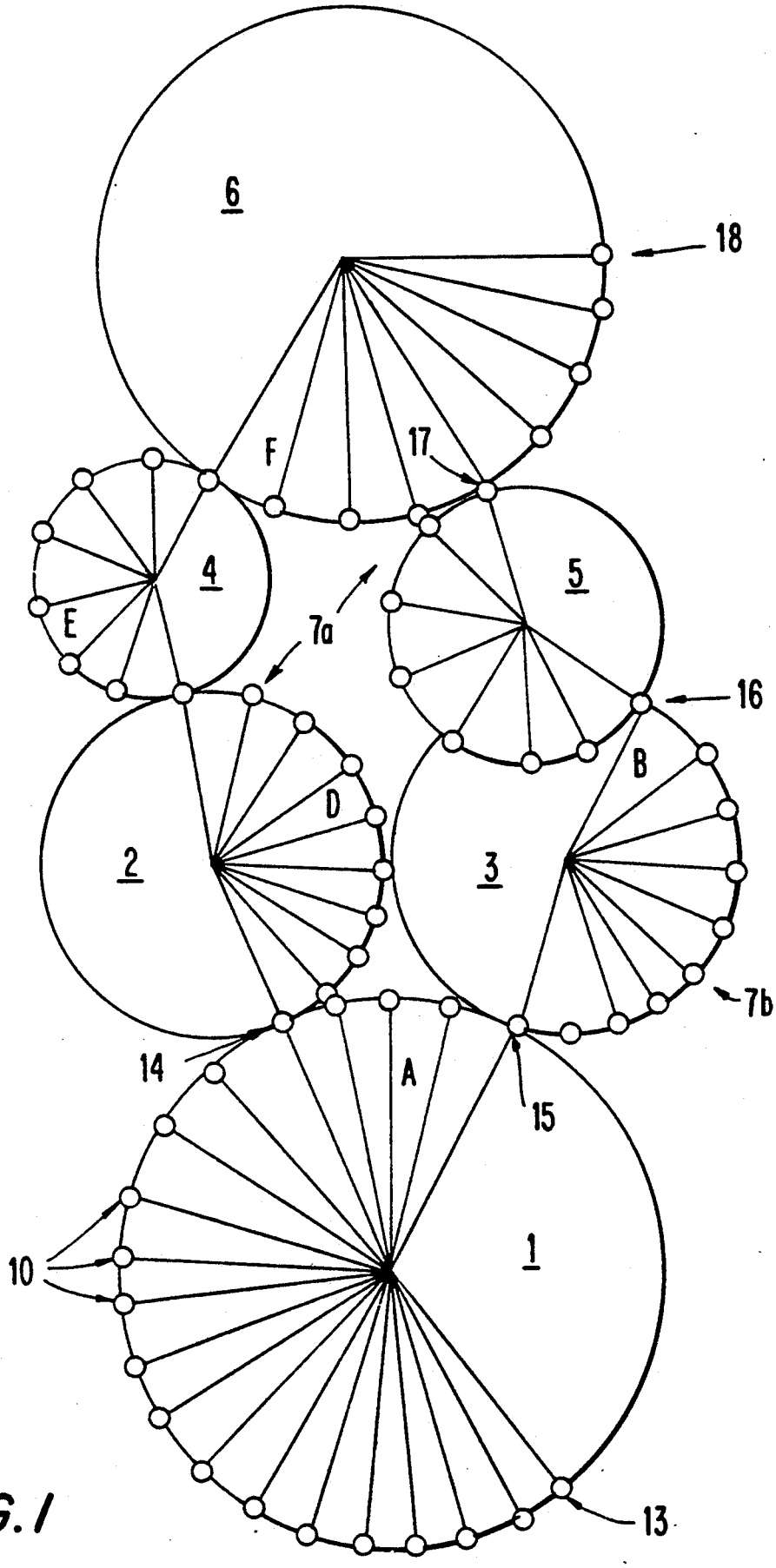

Referring to FIGS. 1 and 3A, randomly oriented components 7 are placed in flutes 10 on the positioning drum 1, on the same side of the datum line 11, without regard to which of the two distinct ends 8 or 9 face inward, i.e., toward the datum line 11, or outward, i.e., away from the datum line 11. The datum line 11 is located midway depthwise on the circumference of the positioning drum 1. Each flute 10 receives a component 7 as it passes the feed point 13.

The flutes 10 are subjected to a controlled vacuum in order to ensure that each component 7 remains in the flute 10 of one drum until it is transferred to the flute 10 of a consecutive drum. In each instance of component transfer, vacuum is released from the flute on the transferring drum—which supports the component—at the precise moment that the component meets the flute on the receiving drum whence vacuum is applied to that component through the flute on the receiving drum thereby effectuating the transfer.

Referring to FIGS. 2A and 2B, the end geometry of the engaging end 8 of the component 7 is distinct from the end geometry of the non-engaging end 9. As can be seen from FIG. 2A, the engaging end 8 of the component 7 in this embodiment is completely capped. However, as can be seen from FIG. 2B, the non-engaging end 9 is only partially capped.

Referring to FIG. 4, the push-rod 12 designed for this embodiment is shaped such that it will engage the engaging end 8 of the component 7 of FIGS. 2A and 2B, but will not engage the non-engaging end 9.

Referring to FIGS. 5A through 5D, in an alternate embodiment, neither end of the component 7 is completely capped, but the ends of the component 7 have distinct end geometry. The push-rod illustrated in FIG. 5C, will engage the end of the component 7 illustrated in FIG. 5a, but will not engage end 8. Alternatively, the push-rod illustrated in FIG. 5D, will engage the end of the component 7 illustrated in FIG. 5B, but not the end of the component illustrated 5A. In this respect, either end of the component 7 can be designated as the engaging-end 8, depending upon the cross-section of the particular push-rod utilized.

Referring to FIGS. 3A and 3B, a cam actuated push rod 12 moves each properly oriented component 7a—i.e., engaging end facing away from the datum line 11—at least partially across the datum line 11 on the positioning drum 1. In this manner, properly oriented components 7a may then be transferred to a flute 10 on a first transfer drum 2 at transfer point 14 and then to a flute 10 on a second transfer drum 4 before reaching a flute 10 on the assembly drum 6 located at the other end of the orienting mechanism.

Improperly oriented components 7b on the positioning drum 1—i.e., engaging end facing towards the datum line 11—will not be moved appreciably by the cam activated push rod 12 and thus will remain substantially on the side of the datum line 11 at which they were originally positioned. These components 7b will therefore remain on the positioning drum 1 past the first transfer point 14, where the properly oriented components 7a are transferred to transfer drum 2, until reaching the second transfer point 15, where they are transferred onto the 180°-turning drum 3. The 180°-turning drum 3 turns each of these components 7b by any method known in the art so as to properly orient each component 7b prior to reaching the third transfer point 16, at which point the turned components are transferred to the 180°-turning-transfer drum 5. In this manner, each component 7 transferred to the assembly drum 6 at the fourth transfer point 17 is properly oriented.

Finally, the components 7, now all properly oriented, meet a last transfer point 18 on the assembly drum which is coaxial to an additional transferring drum (not shown) whereby they are removed from the orienting apparatus. Therefore, properly oriented components 7a are continuously discharged from the assembly drum 6 in a steady stream to another mechanism for further processing.

By properly sizing each of the six drums, each flute 10 on the assembly drum 6 will be filled with a properly oriented component 7a after the flute 10 has rotated past the transfer point on both the second transfer drum 4 and the 180°-turning-transfer drum 5. That is, if both properly aligned components 7a and improperly aligned components 7b travel equivalent total distances along the circumferences of the drums, every flute 10 on the assembly drum 6 will ultimately be filled with a properly oriented component 7a prior to reaching the last transfer point 18. Sizing the drums in this manner will allow the assembly drum 6 to continuously discharge properly oriented components 7a from the orienting apparatus.

The present invention may be utilized in conjunction with a conveyor system, such as disclosed in U.S. Pat. No. 5,127,511. For example, the drums used in the present invention would replace those described in FIG. 1 of that patent. More specifically, the positioning drum of the current invention would replace drum 120 in FIG. 1 of the U.S. Pat. No. 5,127,511.

Thus, it is seen that an apparatus is provided that can discriminate between properly and improperly aligned elongated components oriented in a random manner, and can provide a constant output of components which are properly aligned.

One skilled in the art will appreciate that the present invention can be practiced by other than the described embodiment, which is presented for purposes of illustration and not of limitation, and the present invention is limited only by the claims that follow. For example, components initially oriented with the engaging end facing toward the datum line may be utilized as the desired initial orientation. Additionally, the geometry of the ends of the components and the push-rod may be varied in any way desirable, as long as the push-rod used will engage one, and only one, end of the component.

What is claimed is:

1. An apparatus for orienting elongated components having different ends, wherein the elongated components may be input into the apparatus without regard to their orientation with respect to their ends, comprising:

a positioning mechanism having holding means along its surface for receiving randomly oriented elongated components;

means for identifying and moving improperly oriented elongated components relative to a datum line;

at least one transfer means having a plurality of holding means along the surface of each transfer means for receiving properly oriented elongated components;

a 180°-turning mechanism having a plurality of holding means along its surface for receiving improperly oriented elongated components and turning them 180° to be properly oriented;

an assembly mechanism having a plurality of holding means along its surface for receiving both the originally properly oriented elongated components and the elongated components which have been turned to be properly orientated;

means for maintaining an appropriate relative position between an individual elongated component and an individual holding means; and means for transferring elongated components from a holding means on one mechanism to a holding means on an adjacent mechanism.

2. The apparatus of claim 1, wherein the holding means are flutes.

3. The apparatus of claim 2 wherein the positioning mechanism, the at least one transfer mechanism, the 180°-turning mechanism, and the assembly mechanism are drum-shaped, and the flutes for receiving the elongated components are placed along the circumferences of said mechanisms.

4. The apparatus of claim 3 wherein the flutes for receiving the elongated components are spaced equidistant around the circumference of the positioning mechanism, the at least one transferring mechanism, the 180° turning mechanism, and the assembly mechanism.

5. The apparatus of claim 1 wherein the means for identifying and moving improperly oriented elongated component is relative to the datum line comprises a cam-actuated push rod.

6. The apparatus of claim 1 wherein the means for maintaining an appropriate relative position between individual elongated components and individual flutes, as well as for transferring elongated components from a flute on one mechanism to a flute on an adjacent mechanism, comprises controlled vacuums within the flutes.

7. An apparatus for converting an input stream of randomly aligned elongated components, having distinct ends, into uniform alignment, comprising:

a positioning drum having flutes spaced equidistant along its surface for receiving randomly oriented cylindrical components;

a cam-activated push rod for identifying and moving improperly oriented cylindrical components relative to a datum line;

at least one transfer drum having flutes spaced equidistant along the circumference of each drum for receiving properly oriented cylindrical components from the positioning drum;

a 180°-turning drum having flutes spaced equidistant along its circumference for receiving improperly oriented cylindrical components from the positioning drum and tipturning them 180° to be properly oriented; and an assembly drum having flutes spaced equidistant along its circumference for receiving both the originally properly oriented cylindrical components and the elongated components which have been turned to be properly oriented; and means for maintaining and releasing controlled vacuums within the flutes for transferring cylindrical components from one drum to an adjacent drum.

8. A method of orienting initially randomly oriented elongated components having disparate ends comprising the steps of:

identifying and separating improperly oriented components from properly oriented components, said separating step comprising transferring identified improperly oriented components to an outer surface of a 180°-turning drum and transferring identified properly oriented components to an outer surface of a transfer drum;

turning improperly oriented components 180° to place them in proper orientation;

reintegrating reoriented components with the properly oriented components, said reintegrating step comprising transferring reoriented components from the outer surface of the 180°-turning drum and oriented components from the outer surface of the transfer drum to an outer surface of an assembly drum; and discharging properly oriented components for further processing.

9. The method of claim 8, wherein the properly oriented components are discharged at a steady-stream rate.

10. The method of claim 9, wherein the steady-stream rate at which the properly oriented components are discharged is equivalent to the rate at which randomly oriented components are input into the system.

11. The method of claim 10 wherein improperly oriented components are identified and separated from properly oriented components by a cam-activated push rod.

12. The apparatus of claim 3 further comprising two transfer drums having respective flutes along their circumferences, one transfer drum being associated with said drum-shaped transfer mechanism to transfer the properly oriented elongated component from said drum-shaped transfer mechanism to said drum-shaped assembly mechanism, and the other transfer drum being associated with said drum shaped 180°-turning mechanism to transfer the properly oriented elongated components from said drum-shaped 180°-turning mechanism to said drum-shaped assembly mechanism.

13. The apparatus according to claim 12, wherein said two transfer drums and said drum-shaped positioning mechanism, 180°-turning mechanism, at least one transfer mechanism and assembly mechanism are sized and arranged such that a properly oriented elongated component and an improperly oriented component travel an equal arc distance.

14. The apparatus according to claim 3, wherein said drum-shaped positioning mechanism, 180°-turning mechanism, at least one transfer mechanism and assembly mechanism are sized and arranged such that a properly oriented elongated component and an improperly oriented component travel an equal arc distance.

15. The apparatus of claim 1 wherein the means for identifying and moving improperly oriented elongated components comprises a rod having an end for engaging only one end of the elongated components.

16. The apparatus of claim 12 wherein the means for identifying and moving improperly oriented elongated components comprises a rod having an end for engaging only one end of the elongated components.

17. The apparatus of claim 13 wherein the means for identifying and moving improperly oriented elongated components comprises a rod having an end for engaging only one end of the elongated components.

18. The apparatus according to claim 7 further comprising second and third transfer drums, each second and third transfer drum having flutes spaced equidistantly along its circumference, said second transfer drum being associated with said at least one transfer drum to transfer the properly oriented elongated component from said at least one transfer drum to said assembly drum, and said third transfer drum being associated with said 180°-turning drum to transfer the properly oriented elongated components from said 180°-turning drum to said assembly drum.

19. The apparatus according to claim 7, wherein said rod has an end for engaging only one end of the elongated components.

20. The apparatus according to claim 19 further comprising second and third transfer drums, each second and third transfer drum having flutes spaced equidistantly along its circumference, said second transfer drum being associated with said at least one transfer drum to transfer the properly oriented elongated components from said at least one transfer drum to said assembly drum, and said third transfer drum being associated with said 180°-turning drum to transfer properly oriented elongated components from said 180°-turning drum to said assembly drum.

21. The apparatus accordingly to claim 1, further comprising means for discharging properly oriented elongated components from the assembly mechanism.

* * * * *